US006806654B2

(12) United States Patent
Shannon

(10) Patent No.: US 6,806,654 B2
(45) Date of Patent: Oct. 19, 2004

(54) MATRIX DISPLAY

(75) Inventor: John M. Shannon, Whyteleafe (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 198 days.

(21) Appl. No.: 10/218,365

(22) Filed: Aug. 14, 2002

(65) Prior Publication Data

US 2003/0052840 A1 Mar. 20, 2003

(30) Foreign Application Priority Data

Sep. 18, 2001 (GB) ..... 0122442

(51) Int. Cl.[7] ..... G09G 3/10

(52) U.S. Cl. ..... 315/169.1; 315/169.3; 345/76; 345/77

(58) Field of Search ..... 315/169.1, 169.3; 345/76, 77

(56) References Cited

U.S. PATENT DOCUMENTS 5,589,738 A 12/1996 Onodaka et al. ..... 315/169.1
6,486,606 B1 * 11/2002 Ting ..... 315/169.1
6,583,581 B2 * 6/2003 Kaneko et al. ..... 315/169.3

FOREIGN PATENT DOCUMENTS

| | | |
|---|---|---|
| DE | 3029522 A1 | 3/1982 |
| WO | WO 9619837 | 6/1996 |
| WO | WO 0120591 | 3/2001 |

OTHER PUBLICATIONS

Shannon et al., "Memory switching in amorphous silicon–rich silicon carbide," Electronics Letters, Oct. 28, 1999, vol. 35, No. 22, pp. 1976–1977.

* cited by examiner

*Primary Examiner*—David Vu

(57) ABSTRACT

A matrix display has pixels 2 each including a programmable memory element 30 arranged in parallel across capacitance 28. The voltage on the capacitance controls a display element 25. The arrangement can be run in a normal mode, with all of the memory elements 30 in a high resistance state so that the matrix display can be driven dynamically. Alternatively, in a static (low power) mode of operation, the memory elements 30 are programmed with a static image which may be displayed without driving the data lines 6.

11 Claims, 2 Drawing Sheets

MATRIX DISPLAY

The invention relates to a matrix display, in particular an active matrix display such as a polymer light emitting diode (poly-LED) array, organic light emitting diode (OLED) array, or an active matrix liquid crystal display.

A typical prior art active matrix polymer or organic light emitting diode display has a matrix of light emitting diodes arranged as row and columns. A single pixel of such a display is illustrated in FIG. 1. The pixel 2 is connected to a row select line 4 and a data line 6. A thin film transistor 8 acts as a select transistor, to connect the electronics in the pixel 2 to the data line 6 in accordance with a signal on the select line 4. The select transistor 8 is a thin film transistor having its gate 10 acting as a control terminal connected to the select line 4. The source 12 is connected to the data line 6, and the drain 14 to the remaining components of the pixel. In particular, the drain 14 is connected to the gate or controlled terminal 18 of a pixel thin film transistor 16. The source 20 of the pixel thin film transistor 16 is connected to ground 24, and the drain 22 is connected through light emitting diode 25 to voltage rail 26. A storage capacitor 28 is connected between ground 24 and the control terminal 18 of the further thin film transistor 16.

In use, a charge is loaded through the select transistor 8 when the row select line 4 is appropriately driven. The charge is stored on capacitor 28 which controls the pixel thin film transistor 16 to be in a conducting or a non-conducting state. When the pixel transistor 16 is in a non-conducting state, i.e. switched off, no current passes through the LED and accordingly the pixel element is dark. Conversely, when the voltage on the capacitor 28 is such that the thin film transistor is switched on, current passes between voltage rail 26 and ground 24 through the light emitting diode 25 to make the pixel element bright.

It will be appreciated that in a real display there will be many rows and columns of pixels, and many corresponding select lines 4, data lines 6 and voltage rails 26.

A problem with this type of arrangement is that it is necessary to continually update the signals to continually refresh the voltage on capacitor 28. Thus, every frame every pixel needs to be addressed and the voltage across the capacitor adapted. Whereas this is necessary for displaying dynamic or rapidly changing data, the requirement to continually and repetitively supply data signals with the associated dissipation of power is not needed when a static image is being displayed.

The same considerations apply to other forms of matrix display, in particular to active matrix liquid crystal displays. Again, the liquid crystal pixel has effectively a capacitance that needs to be regularly recharged by continually and repetitively supplying data signals. Again, this wastes power.

Accordingly, it would be beneficial to provide a display that can display static images without the need for continual repetitive data supply, while still maintaining the flexibility of displaying dynamic images where required.

According to the invention, there is provided a matrix display, comprising: a plurality of data lines; a plurality of select lines; and a plurality of pixel elements including: a select transistor connected to a data line, the select transistor having a control terminal connected to a select line, a capacitance for storing charge supplied by the said data line when the pixel element is selected by the select line, the charge providing a voltage across the capacitance, and a display component connected to the capacitance for displaying a pixel image element in accordance with the voltage across the capacitance; characterised in that each pixel includes a programmable element across the capacitance switchable between a low resistance state in which it shorts the capacitance and a high resistance state.

By supplying a programmable element in each pixel element, the programmable elements can be programmed in accordance with a static image so that with appropriate voltages supplied to the data and select lines the image displayed is in accordance with the state of the programmable elements in the various pixels. By programming all of the elements to be in a high resistance state, the matrix display according to the invention can be operated in a conventional manner to display dynamic pictures.

Accordingly, the matrix display can conveniently be used to display either static or dynamic pictures as required. When static pictures are displayed there is no need to supply repetitive data signals and there is a considerable reduction in power consumption.

The programmable element is preferably a metal semiconductor metal structure, and in particularly preferred embodiments an amorphous silicon carbide structure of thickness, for example, between 50 nm and 100 nm may be used as the semiconductor layer. Alternative semiconductor metal semiconductor structures such as amorphous silicon nitride, amorphous silicon, polysilicon or multi-layer structures may also be used.

The capacitance storing charge may be a separate capacitor, or alternatively the programmable element may provide the capacitance for storing charge without the need for an additional component.

Embodiments of the invention provide a light emitting diode type matrix display. The light emitting diode may be connected between first and second voltage rails in series with a pixel transistor having a control terminal connected to the select transistor, and the capacitance and programmable element may be connected between the control terminal of the pixel transistor and the first voltage rail. In this way, the voltage across the capacitance controls whether the pixel transistor conducts to allow current to flow through the light emitting diode so that the pixel is bright or whether the pixel transistor is switched off so that the pixel is dark.

Embodiments of the invention may provide a photodiode connected across the capacitance for receiving light emitted from the light emitting diode to provide negative feedback.

Other embodiments of the invention relate to a liquid crystal matrix display.

The invention also relates to a method of operation of a matrix display as described above, including operating the matrix display in a static mode by: programming the programmable elements of a set of the pixels into a low resistance state, and applying a predetermined voltage to all the data lines to display an image corresponding to the set of pixels programmed into the low resistance state.

The method may further comprise operating the matrix display in a dynamic mode by programming all the programmable elements to be in the high resistance state, and displaying image data by sequentially storing charge on the capacitances of selected pixels so that an image is displayed corresponding to those pixels selected. It is also possible for part of a picture to be static while the remainder is dynamic, for example a static logo in one corner.

Embodiments of the invention will now be described, purely by way of example, with reference to the accompanying drawings in which.

The drawings are purely schematic and not to scale. Corresponding or like components are given the same reference numerals in different figures.

Figure 1:
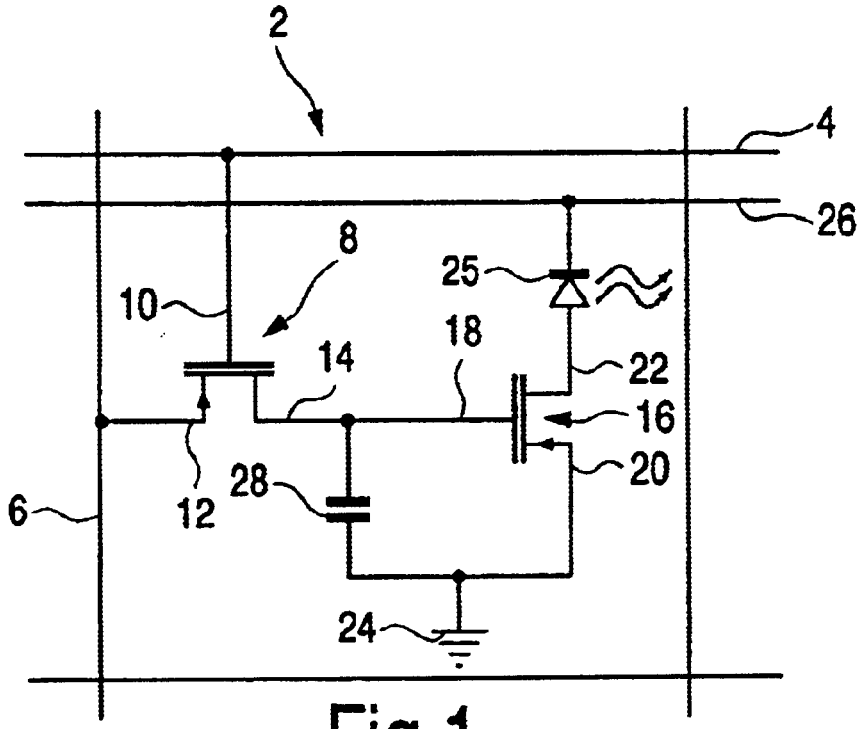
Fig.1 PRIOR ART
FIG. 1 shows a prior art light emitting diode matrix display.
Figure 2:
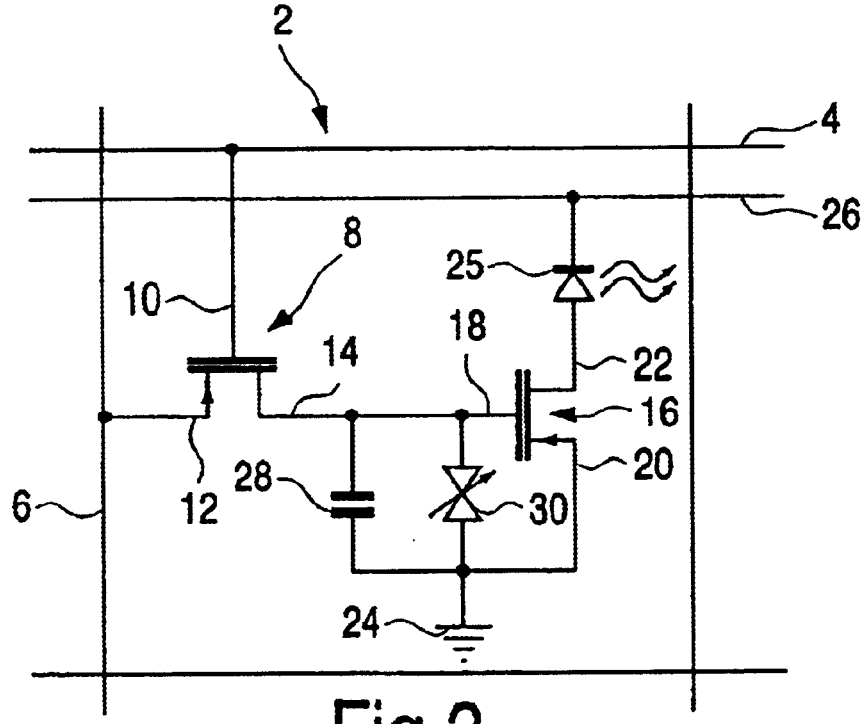
FIG. 2 shows a first embodiment of a pixel element according to the invention.

Referring to FIG. 2, a pixel element 2 of a poly-LED matrix display has the same components as described above with reference to FIG. 1. In addition, a metal semiconductor metal programmable element 30 is provided connected between the gate 18 of the pixel transistor 16 and ground 24.

Suitable metal semiconductor metal structures are described in "Memory switching in amorphous silicon-rich silicon carbide", by J M Shannon and S P Lau in Electronics Letters, Oct. 28, 1999, volume 35 number 22. However, alternative MSM structures may also be used, such as those described in WO 96/19837. The skilled person will be aware of other suitable programmable elements that may be used in connection with this invention.

The MSM structure 30 has a dynamic resistance that can be programmed. Measurements of the amorphous silicon carbide structure used in the present invention have shown that the low resistance state can have a resistance of around 100 ohms, whereas the high resistance state can have a resistance of greater than $10^8$ ohms.

Figure 3:
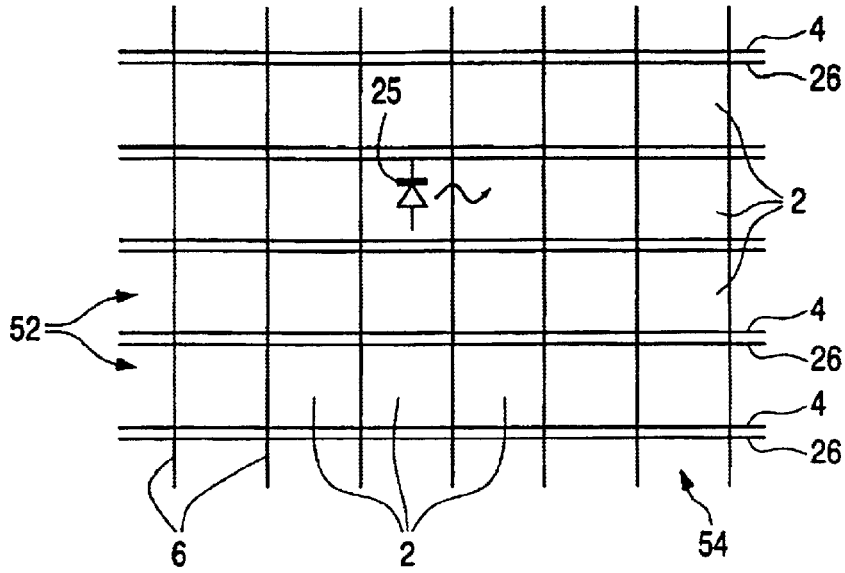
FIG. 3 shows a display having a plurality of pixel elements as shown in FIG. 2.

Referring to FIG. 3, a display includes an array of pixels 2 arranged in rows 52 connected to common row select lines 4 and columns 54 connected to common data lines 6.

The illustrated embodiment shows voltage rail 26 being provided parallel to the row select lines 4. Each pixel 2 includes a display component, here light emitting diode 25.

In use, the matrix display can be operated in a conventional dynamic mode in which all of the MSM structures 30 are in the high resistance state. In this mode, the display can be driven largely in accordance with conventional methods, avoiding excessive voltages, to produce a dynamic image on the display. The row select lines 4 are driven sequentially, and data corresponding to each selected row is supplied to the data lines of the selected row to charge up the capacitances to the desired voltage. Each capacitance may be charged either to a voltage causing the pixel transistor 16 to conduct so that the pixel is bright, or to a voltage which turns off the pixel transistor 16 so that the pixel is dark. Because the leakage through the element 30 is very low, the voltage across the capacitor 28 and on the gate of transistor 18 remains essentially constant throughout the frame time.

However, the matrix display can also be operated in a different mode by programming the MSM elements 30 in accordance with the desired image. Depending on whether the MSM element of each pixel is in the high resistance state or the low resistance state, the pixel element is bright or dark respectively. An image may accordingly be formed by suitably programming the memory elements 30 of the pixels of the array so that a static image can be displayed without the need to continually refresh the voltage stored on the capacitor 28.

The programming steps used will now be described in more detail.

The amorphous silicon carbide memory elements 30 used require a forming step before use. This is carried out by applying positive eight volts on the data line and switching the select transistor 8 hard on. The forming step is believed to create one or more local filaments in the amorphous silicon carbide layer that are then subsequently switched.

In order to switch the elements 30 to a high resistance state, minus six volts is supplied on the data line 6 with the select transistor 8 hard on. After this programming the display operates as a conventional prior art display.

In order to switch over to a static display, selected elements 30 are switched to a low resistance state. This is done by applying plus six volts on the data line 6 with the select transistor 8 being hard on.

In order to display the programmed image, it is simply necessary to supply minus four volts on all the data lines 6 and cycle the row select lines 4 as in conventional arrangements. In those pixel elements 2 in which the memory elements 30 are in a low resistance state charge stored on the capacitor 28 when the row select line 4 selects the pixel leaks from capacitor 28 through low resistance memory element 30 in a short time scale compared with the frame time. The frame time is the period between successive occasions that the row select line 4 is driven to turn the select transistor 8 on. Since the charge on the capacitor 28 is discharged over a short time scale, little light is emitted from the light emitting diode 25. In contrast, for those pixels 2 having memory element 30 in a high resistance state, charge on the capacitor 28 does not discharge and accordingly the pixel transistor 16 is switched on so that the pixel is in a bright state.

To return to the normal mode, all elements 30 are switched to a high resistance state by applying minus six volts on the data line with the select transistor on. The normal mode then operates with data voltages less than six volts to avoid the risk of reprogramming the memory elements 30.

By providing three colours of pixel (red, green and yellow) in which each pixel can be on or off, the invention can provide an eight colour display. Alternatively, by providing additional brightness states, for example by using programmable elements that have more than just two states, a display offering a larger number of colours per pixel may be provided. Suitable multiple programmable elements, delivering so-called "analog switching", have been reported.

Figure 4:
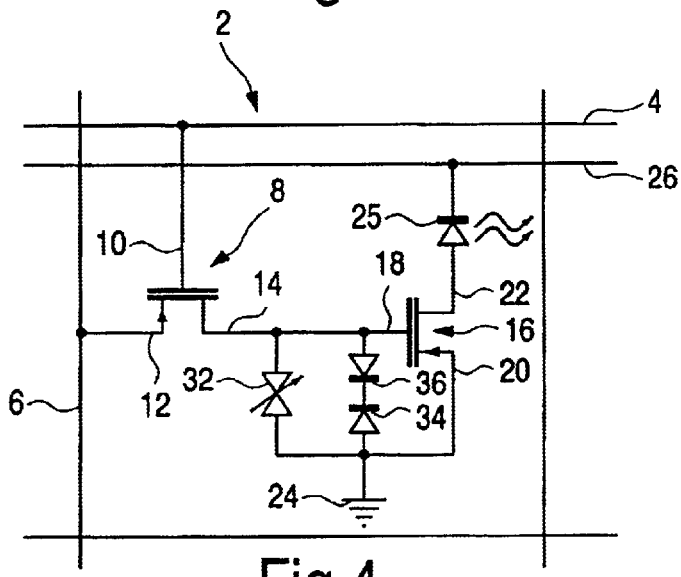
FIG. 4 shows a second embodiment of a pixel element according to the invention.

In a modification of the invention, illustrated in FIG. 4, the capacitor 28 is replaced by a combined capacitance and programmable element 32 which provide the functions both of the capacitor 28 and the programmable element 30 of the embodiment of FIG. 2.

FIG. 4 illustrates a further development of the invention. A photo-diode 36 is connected in series with a blocking diode 34. The photo-diode is arranged so that it can receive light emitted by the light emitting diode 25. This creates negative feedback, as explained in more detail in WO 01/20591.

Figure 5:
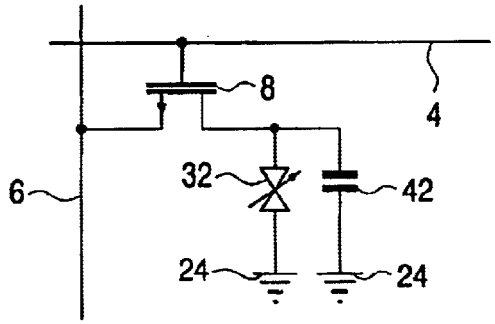
FIG. 5 shows a third embodiment of a pixel element according to the invention.

Referring to FIG. 5, the invention is not solely useful in polymer light emitting diode display, but may also be applied in a liquid crystal display. A combined programmable switch and storage capacitor 32 is provided across the capacitance of the liquid crystal pixel. Again, when the programmable switch is in its high resistance state the matrix display may operate as normal. To display static data, a fixed picture may be displayed, by programming some of the switches to be in a low resistance state. The pixel elements will have the liquid crystal capacitor 42 discharged over a short time scale whereas in the element in which the programmable switch is in the high resistance state voltage stored on the capacitor remains for a full frame. It should be noted that the combined element 32 is grounded on one side so that it acts as a storage capacitor when the liquid crystal display is operated in normal mode. The inclusion of a storage capacitor not only improves the quality of the liquid crystal display but also eases the low leakage requirements of the element 32 in the off state.

It should be noted that although in the described embodiments p-channel thin film select transistors 8 and pixel transistors 16 are used, the invention may also use n-channel field effect transistors. Multiple colour photodiodes may be used for a colour display, or alternatively a single colour of photodiode may be used for a monochrome display.

From reading the present disclosure, other variations and modifications will be apparent to persons skilled in the art. Such variations and modifications may involve equivalent and other features which are already known in the design, manufacture and use of semiconductor devices and which may be used in addition to or instead of features described herein.

What is claimed is:

1. A matrix display, comprising:

a plurality of data lines;

a plurality of select lines; and a plurality of pixel elements including:

a select transistor connected to a data line, the select transistor having a control terminal connected to a select line, a capacitance for storing charge supplied by the said data line when the pixel element is selected by the select line, the charge providing a voltage across the capacitance, and a display component connected to the capacitance for displaying a pixel image element in accordance with the voltage across the capacitance;

characterised in that each pixel includes a programmable element across the capacitance switchable between a low resistance state in which it shorts the capacitance and a high resistance state.

2. A matrix display according to claim 1 wherein the programmable element is a metal semiconductor metal structure.

3. A matrix display according to claim 2 wherein the metal-semiconductor-metal structure includes an amorphous silicon carbide semiconductor layer.

4. A matrix display according to claim 1 wherein the capacitance is integrated within the programmable element.

5. A matrix display according to claim 1 wherein the display component is a light emitting diode.

6. A matrix display according to claim 5 wherein:

the light emitting diode is connected between first and second voltage rails in series with a pixel transistor having a control terminal connected to the select transistor, and the capacitance and programmable element are connected between the control terminal of the pixel transistor and the first voltage rail so that the voltage across the capacitance controls whether the pixel transistor conducts to allow current to flow through the light emitting diode so that the pixel is bright or whether the pixel transistor is switched off so that the pixel is dark.

7. A matrix display according to claim 5 further comprising a photodiode connected across the capacitance for receiving light emitted from the light emitting diode to provide optical feedback.

8. A matrix display according to claim 1 wherein the display component is a liquid crystal pixel electrode.

9. A matrix display according to claim 1 wherein the programmable element is switchable between at least three states, including the low resistance state, the high resistance state and at least one intermediate resistance state.

10. A method of operation of a matrix display including a plurality of data lines, a plurality of row select lines and a plurality of pixel elements, each pixel element including a select transistor, a capacitance, a display component connected to the capacitance and a programmable element across the capacitance switchable between a low resistance state in which it shorts the capacitance and a high resistance state, the method including operating the matrix display in a static mode by:

programming the programmable elements of a set of the pixels into a low resistance state; and applying predetermined voltages to all the data lines and select lines to display an image corresponding to the set of pixels programmed into the low resistance state.

11. A method of operation of a matrix display according to claim 10 further comprising operating the matrix display in a dynamic mode by:

programming all of the programmable elements to be in the high resistance state; and displaying image data by repeatedly sequentially storing charge on the capacitances of selected pixels so that an image is displayed corresponding to the selected pixels.

* * * * *